US006276687B1

(12) United States Patent
Lenhart

(10) Patent No.: US 6,276,687 B1
(45) Date of Patent: Aug. 21, 2001

(54) METHOD AND APPARATUS FOR A GAME

(76) Inventor: Herbert S. Lenhart, 12255 Prairie Dunes Rd., Boynton Beach, FL (US) 33437

( * ) Notice: Subject to any disclaimer, the term of this patent is extended or adjusted under 35 U.S.C. 154(b) by 0 days.

(21) Appl. No.: 09/577,648

(22) Filed: May 24, 2000

(51) Int. Cl.[7] ..... A63F 3/00
(52) U.S. Cl. ..... 273/267; 273/264; 273/271
(58) Field of Search ..... 273/262, 263, 273/264, 267, 271

(56) References Cited

U.S. PATENT DOCUMENTS

| | | | |
|---|---|---|---|
| 429,250 | | 6/1890 | Sperl . |
| 653,303 | * | 7/1900 | Macdonald . |
| 1,342,884 | | 6/1920 | Anderson . |
| 1,607,660 | * | 11/1926 | Zabriskie . |
| 1,666,359 | | 4/1928 | Steves . |
| 3,753,562 | * | 8/1973 | Knowlton . |
| 3,784,205 | * | 1/1974 | Cross, Jr. . |
| 4,754,979 | | 7/1988 | Vaseen . |
| 5,085,440 | * | 2/1992 | Van Dam . |
| 5,269,531 | | 12/1993 | McNamara . |
| 5,344,153 | * | 9/1994 | Watanabe . |
| 5,443,268 | * | 8/1995 | Mayfield et al. . |
| 6,065,751 | * | 5/2000 | Armstrong . |

* cited by examiner

*Primary Examiner*—William M. Pierce
(74) *Attorney, Agent, or Firm*—Stearns Weaver Miller Weissler Alhadeff & Sitterson, P.A.

(57) ABSTRACT

A board game, comprising a game board, a scoreboard, playing pieces, and a playing method and strategy. The game board includes a grid of approximately sixty-four spaces. The game may be played between two players or two teams. The game includes two sets of thirty-two (32) game pieces, each set being a different color with one color for each player/team. The object of the game is for each player, in turn, to place their game pieces on the board within the spaces provided in a manner that forms squares of one color. The spaces between the corners of the squares must be equal but do not have to be filled in to receive points. An additional object is to place game pieces in positions that prevent the opponent from completing squares. The squares may be horizontal or diagonal. Points are won for each square formed of one color, with more points being awarded for larger squares. The point system is preferably based on the number of spaces between the corners of the squares. The points may be multiplied for squares having the sides filled in with game pieces. The player/team with the most points wins at the end of the game. A game may end after no more squares can be made or after a player/team reaches a predetermined point total. Points may be kept by a separate score keeping component such as a scoreboard (i.e., peg board), separate or integral, or automatically if the game is computer based. Alternate embodiments include versions of the game for use while traveling, such as a version wherein the game board and score keeping component are contained on a sheet of paper (wherein multiple sheets may be combined in a pad) to facilitate the playing of the game with writing instruments and a version wherein the game board and playing pieces are connectable by either magnetic attraction and/or peg and hole mating connection.

12 Claims, 8 Drawing Sheets

METHOD AND APPARATUS FOR A GAME

CROSS-REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to games, and, more particularly to a board game where the object is for players to form square patterns by placing pieces on a checker-type game board. A player accumulates points for each square pattern formed and the player with the highest point total wins.

2. Description of Related Art

Games provide players with a source of entertainment and mental stimulation. Some of the most popular games are played on "boards" which are often marked off into patterns or other kinds of divisions. Perhaps the most well known game board is the checker/chess game board. The popularity of board games is evidenced by games disclosed in the background art.

One popular game enjoyed by many is the game of squares, which is commonly played using a pencil and paper. When using a pencil and paper, the players must first construct a playing field by making a series of dots equidistant from each other and in parallel rows. Then the players take turns connecting the dots while attempting to form squares. As the game progresses, dots are connected until three sides of a square on a portion of the playing field are formed. The player who draws the line forming the fourth side of a square scores a point, and marks his or her initial within the square as a tally. The player having formed the most squares at the end of the game wins. The popularity of the game of squares is reflected in a number of board game references disclosed in the background art.

U.S. Pat. No. 429,250, issued to Sperl et al., discloses a game board having a series of intersecting grooves forming a number of disconnected squares. Two players take turns at inserting small sticks or blocks, having lengths corresponding to the lengths of the sides of the squares, into the grooves while attempting to fully surround the greatest number of squares prior to the end of the game. The player who has enclosed the greatest number of squares is the winner. Similarly, U.S. Pat. No. 1,666,359, issued to Steves, discloses a game board adapted for playing the well known games of checkers and chess. The board further defines a series of intersecting grooves such that the board may also be used for playing the game of squares.

U.S. Pat. No. 1,342,884, issued to Anderson, discloses a board game apparatus having a plurality of upwardly projecting posts disposed in rows. Each post includes angularly spaced sockets extending toward the adjacent members. Players take turns placing elongated pieces in position connecting adjacent post members, either in a direction parallel to the side of the game board or diagonally thereto. The object for each player is to place in the socket the third playing piece which completes the outlining of a triangle. The player who completes the most triangles wins.

U.S. Pat. No. 4,754,979, issued to Vaseen, discloses a board game wherein players, using colored chips, attempt to form patterns of numbers, letters, or geometric designs. Values are established for each pattern to determine the winner.

U.S. Pat. No. 5,269,531, issued to McNamara, discloses a board game having a board which includes two distinguishable sets of nodes, each set of nodes being fixed to the board in an intermingled pattern. Players place game pieces on the board and relative to said nodes to achieve a desired pattern.

The games of the background art neither teach, nor suggest, a squares board game having game pieces that may be placed to form open-sided and/or closed-sided squares and wherein scoring is dependent upon the relative sides of the squares. Furthermore, the references of the background art do not disclose a multi-level squares board game wherein squares may be formed vertically.

BRIEF SUMMARY OF THE INVENTION

The present invention comprises a board game, identified by the trademark "QUADRA", including a game board, a scoreboard, playing pieces, a playing method and strategy. The invention is intended primarily as a board game, but may be adapted for computer use. In a preferred embodiment, the board comprises a grid of approximately sixty-four spaces, and may be fabricated from cardboard, wood, plastic, or any other suitable material. In an alternate embodiment, the game may be embodied as a computer game having the components appearing on a computer display. Furthermore, in an embodiment for use while traveling the game board and playing pieces may be magnetically connectable and/or peg holes may be defined in the game board for receiving suitably adapted playing pieces having a projecting peg on the bottom thereof. In addition, any other suitable means of retaining the playing pieces on the game board is considered within the scope of the present invention. Another embodiment for travel use may comprise a pad of paper sheets depicting the game board and played using writing instruments of contrasting colors. The game may be played between two players or two teams, each team comprised of at least two players alternating turns. The game includes two sets of thirty-two (32) game pieces, each set being a different color with one color for each player/team. The object of the game is for each player, in turn, to place their game pieces on the board within the spaces provided in a manner that forms squares of one color. The spaces between the corners must be equal but do not have to be filled in to receive points. An additional object is to place game pieces in positions that prevent the opponent from completing squares. The squares may be horizontal or diagonal. Points are won for each square formed of one color, with more points being awarded for larger squares. The point system is preferably based on the number of spaces between the corners. The points may be multiplied for squares having the sides filled in with game pieces. The player/team with the most points wins at the end of the game. A game may end after no more squares can be made or after a player/team reaches a predetermined point total.

Points may be kept by a score keeping component, such as a scoreboard (i.e., peg board), which may be integral, attachable, and/or detachable, or a score sheet, or automatically if the game is computer based.

It is an object of the present invention to provide a simple yet challenging parlor game for amusement and pleasure.

Still another object of the present invention is to provide a new and useful game apparatus and method for playing a game wherein points are awarded for forming geometric figures.

Yet another object of the present invention is to provide a method of playing and scoring a version of the game of squares.

Still another object of the present invention is to provide a game apparatus and method for playing a multi-level version of the game of squares.

In accordance with these and other objects which will become apparent hereinafter, the present invention will now be described with particular reference to the accompanying drawings.

DETAILED DESCRIPTION OF THE INVENTION

Figure 1:
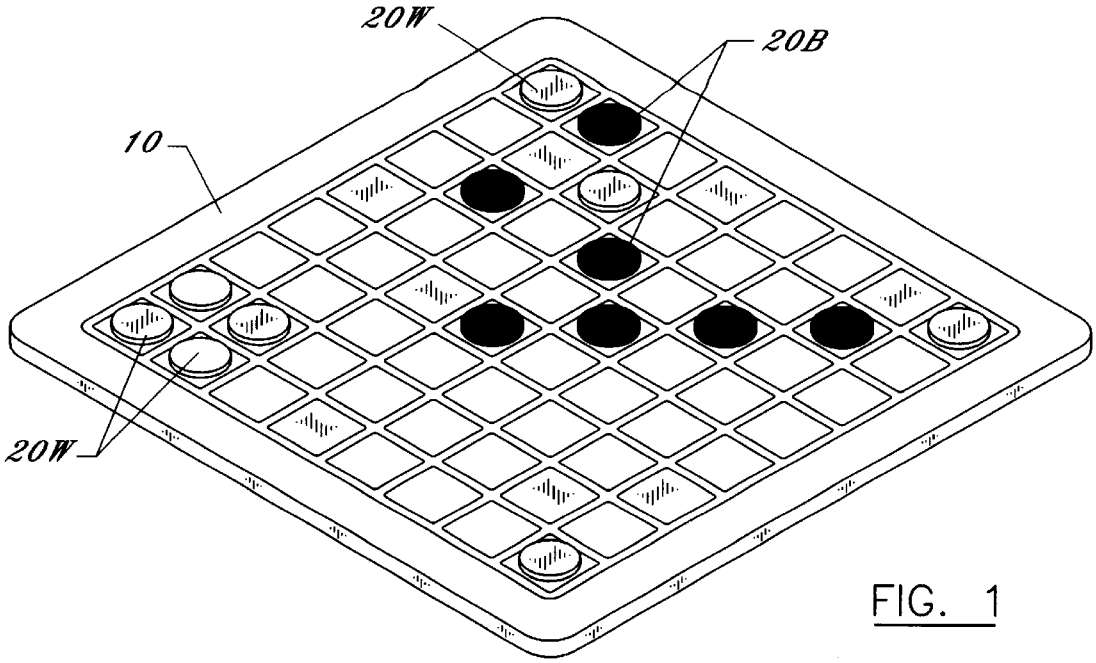
FIG. 1 is a top perspective view of a preferred embodiment of the game board of the present invention having playing pieces disposed thereon.
Figure 2:
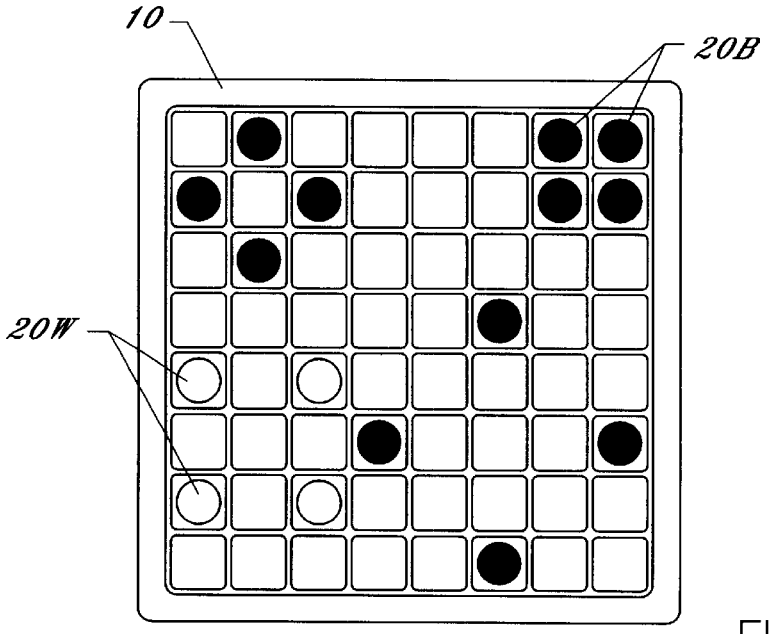
FIG. 2 is a top plan view of the game board shown in FIG. 1 having playing pieces disposed thereon.

With reference now to the drawings, and particularly to FIGS. 1 and 2, the invention includes a game board, generally referenced as 10, that is preferably constructed in the form of a square and defines a series of sub-squares arranged in uniform rows, similar to a checker/chess board. In the preferred embodiment, game board 10 includes sixty-four (64) squares arranged in an eight-by-eight (8×8) pattern. The game further includes a plurality of playing pieces, referenced as 20, preferably 64 playing pieces, 32 each of two contrasting colors, such as black and white referenced as 20B and 20W. Playing pieces 20 are each preferably sized for corresponding placement within one of the sixty-four game board squares.

Figure 5:
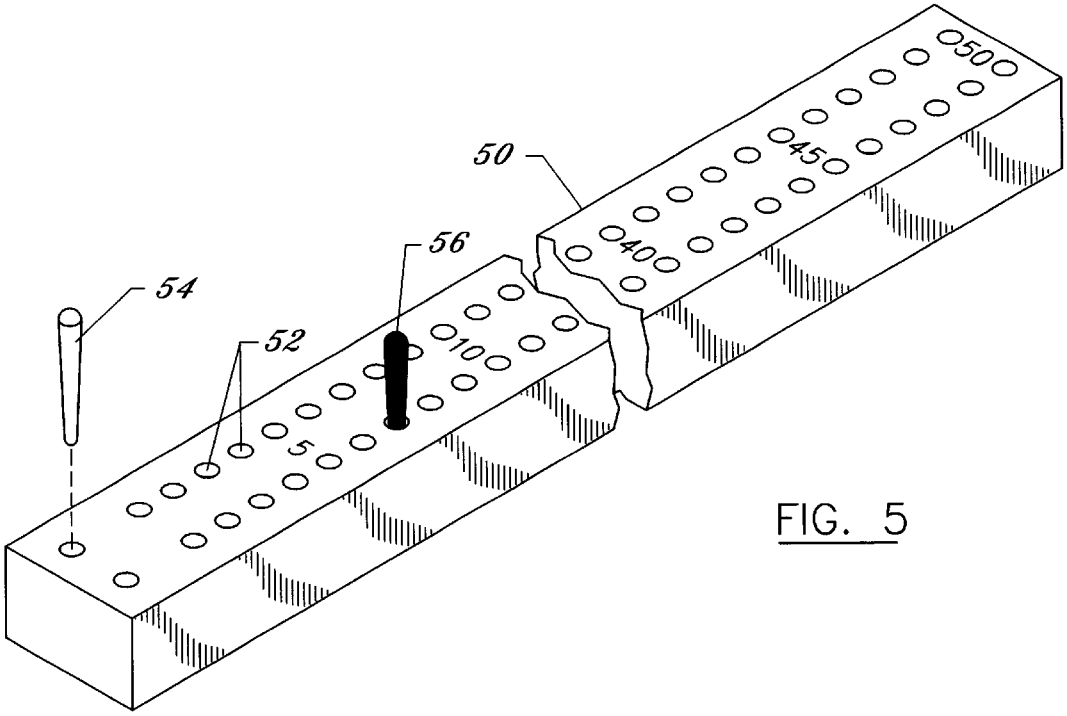
FIG. 5 depicts a preferred embodiment of a peg-board score tracking apparatus for use with the present invention.

As best seen in FIG. 5, a scoreboard 50 provides means for tallying each player's respective score. The scoreboard may be integrally formed with the game board or may be separate therefrom. In the preferred embodiment, the scoreboard comprises an elongate rectangular member having a plurality of peg holes, referenced as 52, arranged in two distinct columns for receiving scoring pegs 54 therein. The peg holes are preferably marked with scoring indicia (e.g., 5, 10, 15, 20, etc.) such that placement of scoring pegs within specific peg holes provides means of keeping score. A pair of scoring pegs 54 and 56 are removably received within said peg holes 52 to indicate each player's current score. As is apparent, scoring pegs 54 and 56 are selectively movable by the players to positions indicative of each player's score. Scoring pegs 54 and 56 are preferably contrasting colors corresponding to each player's playing piece colors, e.g., white and black. The scoreboard may be vertical or horizontal, and may be elongate, circular, or any other suitable configuration. In addition, the scoreboard may be comprised of two parallel tracks, each containing slideable markers of contrasting colors, which markers arc positionable at different points on the tracks to indicate score progress during the course of the game, whereby each player's score is indicated by the position of that player's marker adjacent to numerical indicia disposed on the scoreboard between the two tracks.

The object of the game is to form as many squares as possible and to score the highest number of points. The method of playing the game provides that players alternate turns placing playing pieces on squares of the game board while attempting to form a square pattern. A turn is defined as a player placing a single playing piece on one of the 64 game board squares. During a game a player may also attempt to hinder or block the formation of a square by the player's opponent by the use of strategy and particularly by the placement of the player's playing pieces in positions to block formation of an opponent's square. Each time a square is formed the point value of that square is noted on the scoreboard. Play terminates when squares can no longer be formed or when a player/team reaches a predetermined point total.

Figure 3A:
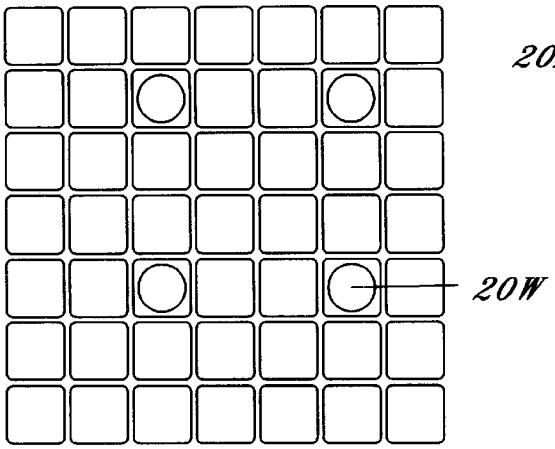
FIG. 3A is a top plan view of the game board having playing pieces disposed thereon forming a horizontal/parallel open-sided square pattern worth four points.
Figure 3B:
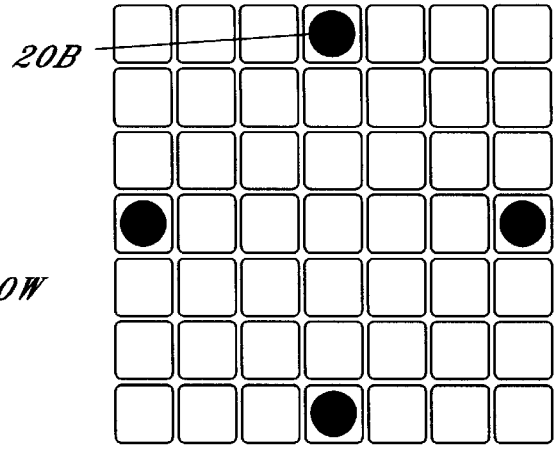
FIG. 3B is a top plan view of the game board having playing pieces disposed thereon forming a diagonal open-sided square pattern worth four points.
Figure 3C:
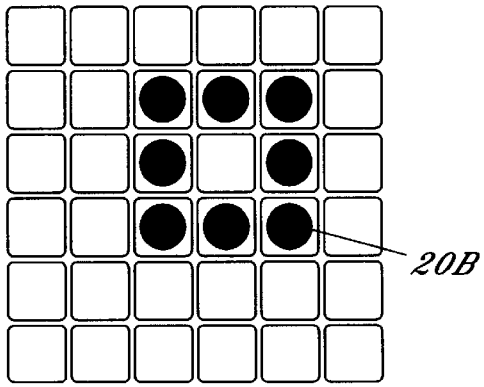
FIG. 3C is a top plan view of the game board having playing pieces disposed thereon forming a horizontal/parallel closed-sided square pattern worth six points.
Figure 3D:
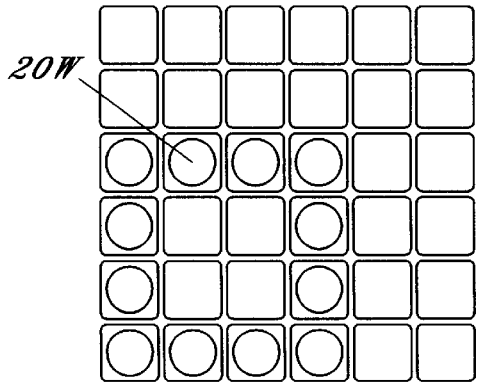
FIG. 3D is a top plan view of the game board having playing pieces disposed thereon forming an alternately positioned and sized closed-sided square pattern worth eight points.

Scoring is achieved by the formation of squares. A square is formed when four of a player's playing pieces are positioned on the game board at locations that are an equal number of spaces apart, regardless of whether the spaces (if any) on the game board between the corners of the formed square are occupied by an opponent's pieces or vacant. Squares may be of any size, and may be configured in parallel alignment with the edges of the game board or diagonally thereto. Squares may be formed as "open-sided" squares by four playing pieces positioned at "corner" locations, or may be formed as "closed-sided" squares in which playing pieces form a fully enclosed square pattern. The number of spaces along one side of an "open-sided" square (i.e., from corner to corner) are valued at one point each and two points each for "closed-sided" squares. By way of example, the "open-sided" square shown in FIG. 3A is worth four points, however, if the perimeter spaces were occupied with playing pieces (of the same color), as shown in FIG. 3D, the pattern would form a "closed-sided" square worth eight points.

With reference to FIG. 1, playing pieces 20W depict the formation of a horizontal "basic" square comprising four playing pieces worth two points. Similarly, with reference to FIG. 2, playing pieces 20B depict the formation of a diagonal "basic" square comprising four playing pieces worth two points. Turning now to FIGS. 3A through 3F, there are depicted examples of a variety of scoring configurations. FIG. 3A depicts a horizontal/parallel open-sided square worth 4-points, wherein four white playing pieces, referenced as 20W, are positioned on the game board at locations corresponding to the four corners of a square. FIG. 3B depicts a diagonal open-sided square worth 4-points, wherein four black playing pieces, referenced as 20B, are positioned on the game board at locations corresponding to the four corners of a square. FIG. 3C depicts black playing pieces configured to form a closed-sided square worth 6-points. FIG. 3D depicts white playing pieces configured to form a closed-sided square worth 8-points. FIG. 3B depicts white playing pieces diagonally configured to form a closed-sided square worth 6-points. FIG. 3F depicts black playing pieces diagonally configured to form a closed-sided square worth 8-points. FIGS. 4A and 4B illustrate the completion of squares by the placement of any of pieces A, B, or C around previously placed pieces (shown as unmarked white pieces forming either a horizontal "T"—FIG. 4A, or a diagonal "T"—FIG. 4B). Similarly, FIGS. 4C and 4D illustrate the completion of squares by the placement of piece X, followed by the placement of any of pieces A, B, C, or D around previously placed pieces (shown as unmarked white pieces forming a horizontal "F"—FIG. 4C, or a diagonal "T"—FIG. 4D). The placement of piece X essentially creates an "angle" pattern as illustrated in FIGS. 4C and 4D. The angle pattern offers additional possibilities for forming point-scoring squares. Furthermore, as best seen in FIGS. 4E and 4F the placement of piece C, before the placement of pieces A or B creates a four-way "T" pattern which makes possible the completion of up to four 2-point squares and creates the possibility for a 6-point closed-sided square, or QUADRA, as seen in FIGS. 4G and 4H. A Quadra, as that term is defined in connection with the game disclosed herein, is any closed-sided square formed with three or more playing pieces per side.

As is now apparent, by the strategic placement of playing pieces on game board 10 in certain patterns, i.e., horizontal "T", diagonal "T" etc., players may improve the odds of forming squares (e.g., basic, open, and/or Quadras). For example, the formation of a "T" shaped pattern by a player assures the completion of at least one square as only one potential square can be blocked by said player's competitor as best seen in FIGS. 4A and 4B. In addition, the formation of a four-way "T" as seen in FIGS. 4E and 4F, assures the completion of two squares, since only two of the potential four squares can be blocked by the player's competitor. As should be apparent, the patterns may be arranged in any direction e.g., horizontal, diagonal, sideways, or upside down. Further, the patterns may be of any size suitable for the formation of open-sided or closed-sided squares.

Figure 6:
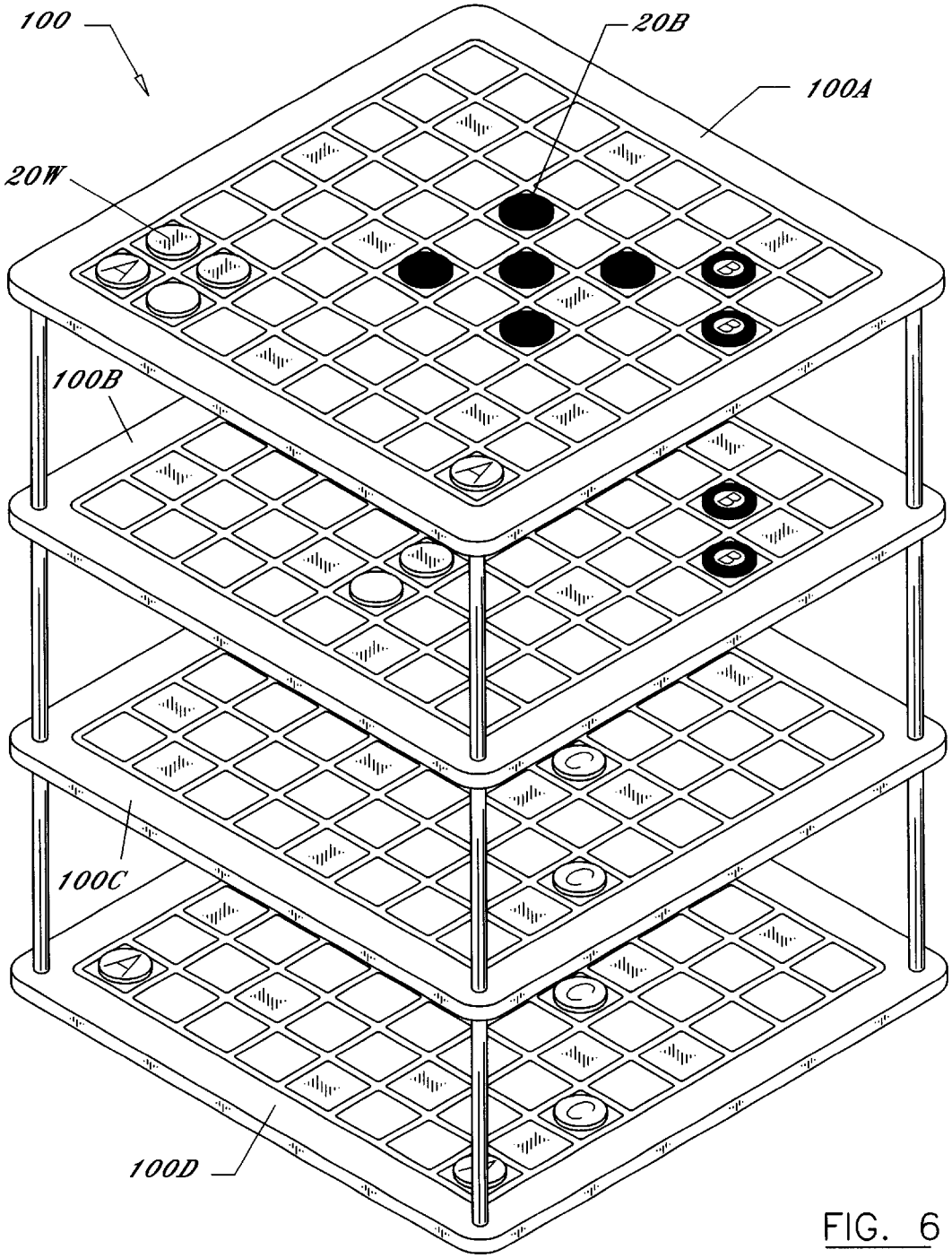
FIG. 6 depicts a multi-level embodiment wherein scoring may be achieved in a vertical configuration.

FIG. 6 depicts an alternate multi-level embodiment of the game of the present invention. The multi-level embodiment includes a multi-level game board 100, having four layers, referenced as 100A, 100B, 100C, and 100D respectively. Each of said game board layers 100A–D comprises a game board having playing areas that are identical to the single layer board 10 referenced hereinabove. As best illustrated in FIG. 6, point-scoring squares may be formed horizontally on any single level or may be formed vertically by pieces on multiple levels. Specifically, white playing pieces referenced as "A" placed on the top game board level 100A and bottom game board level 100D cooperate to form a vertical open-sided square worth a specified number of points, e.g., 4-points. As also seen in FIG. 6, point-scoring squares may be vertically formed on any two adjacent layers. For example, black playing pieces, referenced as "B", on game board levels 100A and 100B form a vertical square worth 2-points. However, the white playing pieces referenced as "C" on game board levels 100C and 100D do not form a vertical square as they have unequal sides. The number of points per vertically formed square may increase with the number of game board levels involved, and depending upon whether the vertical square is closed-sided or open-sided.

Figure 7:
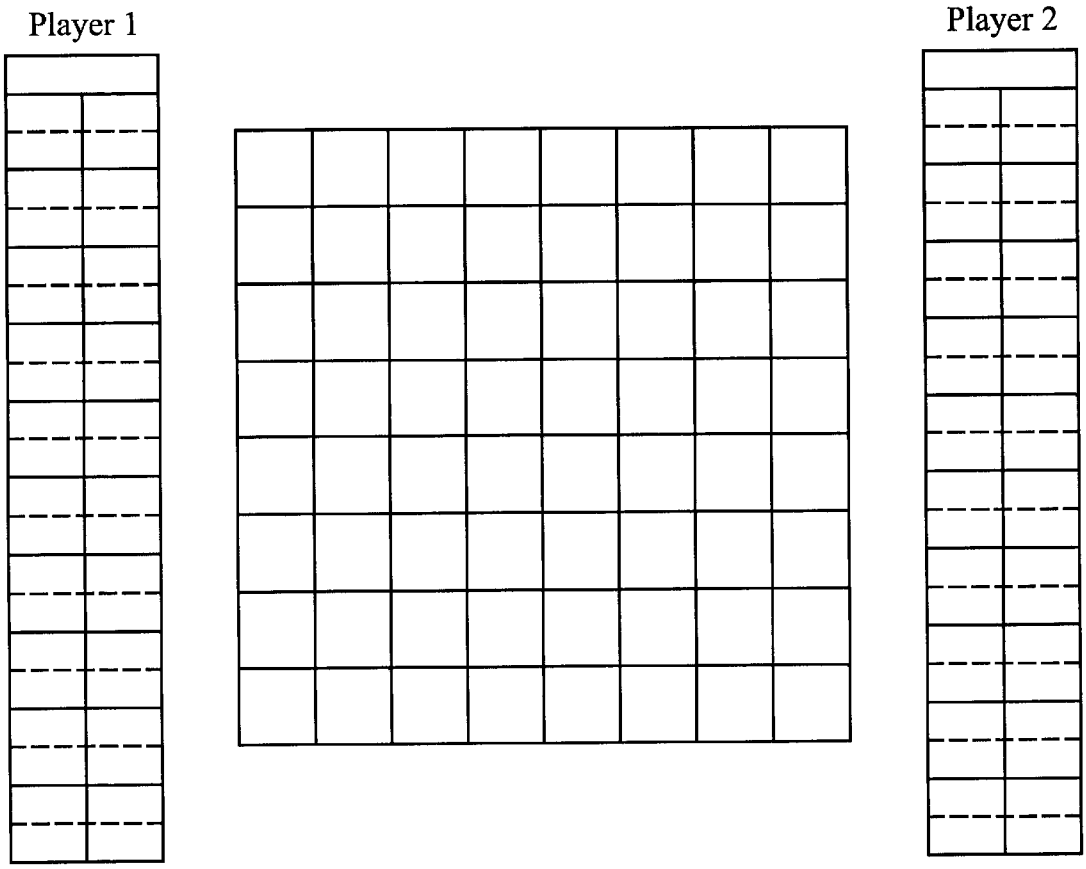
FIG. 7 depicts an embodiment of the game incorporated onto a sheet of paper and capable of being played using writing instruments.
Figure 8:
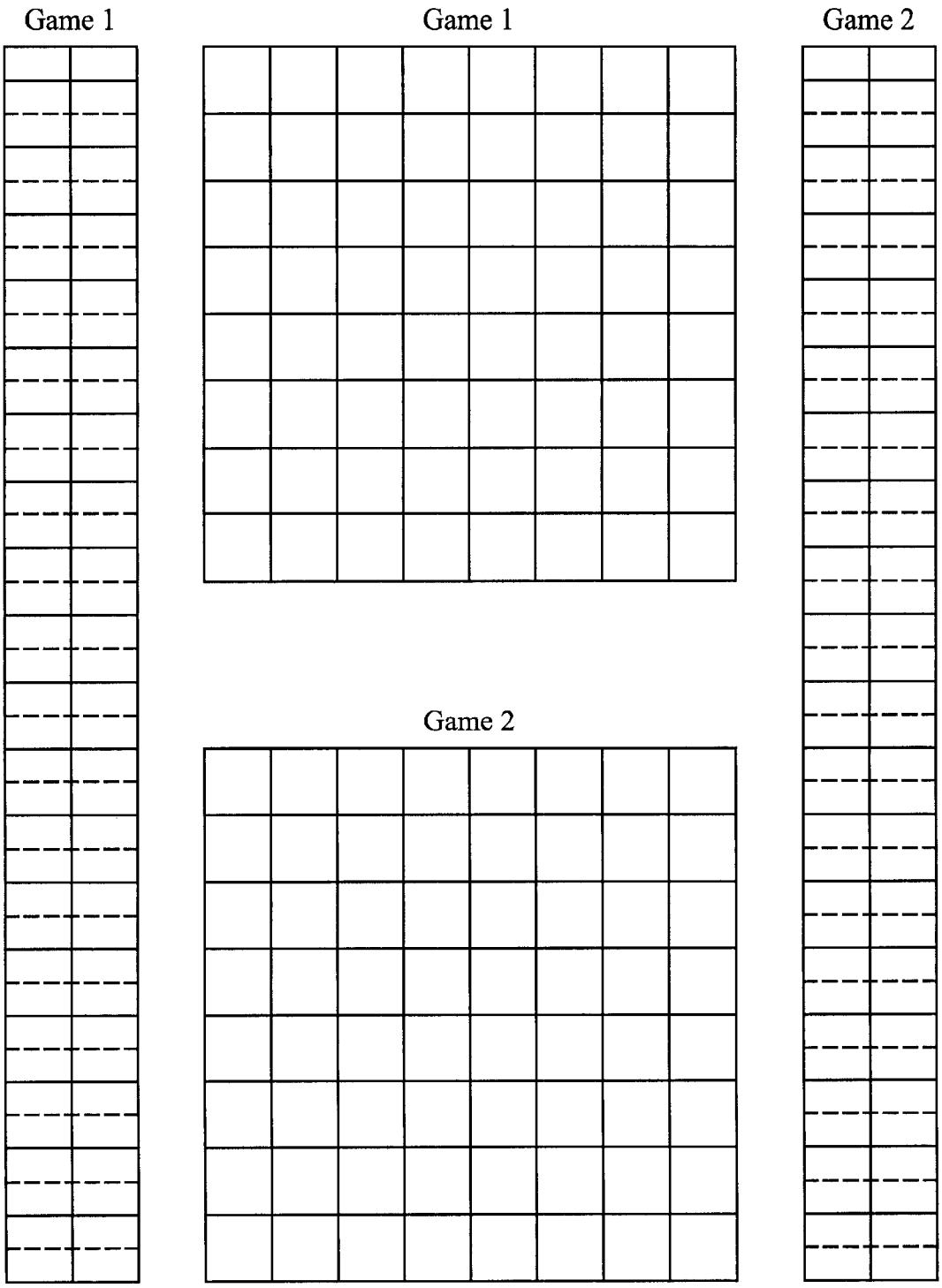
FIG. 8 depicts an alternate, multi-game embodiment of the game incorporated onto a sheet of paper and capable of being played using writing instruments.
Figure 9:
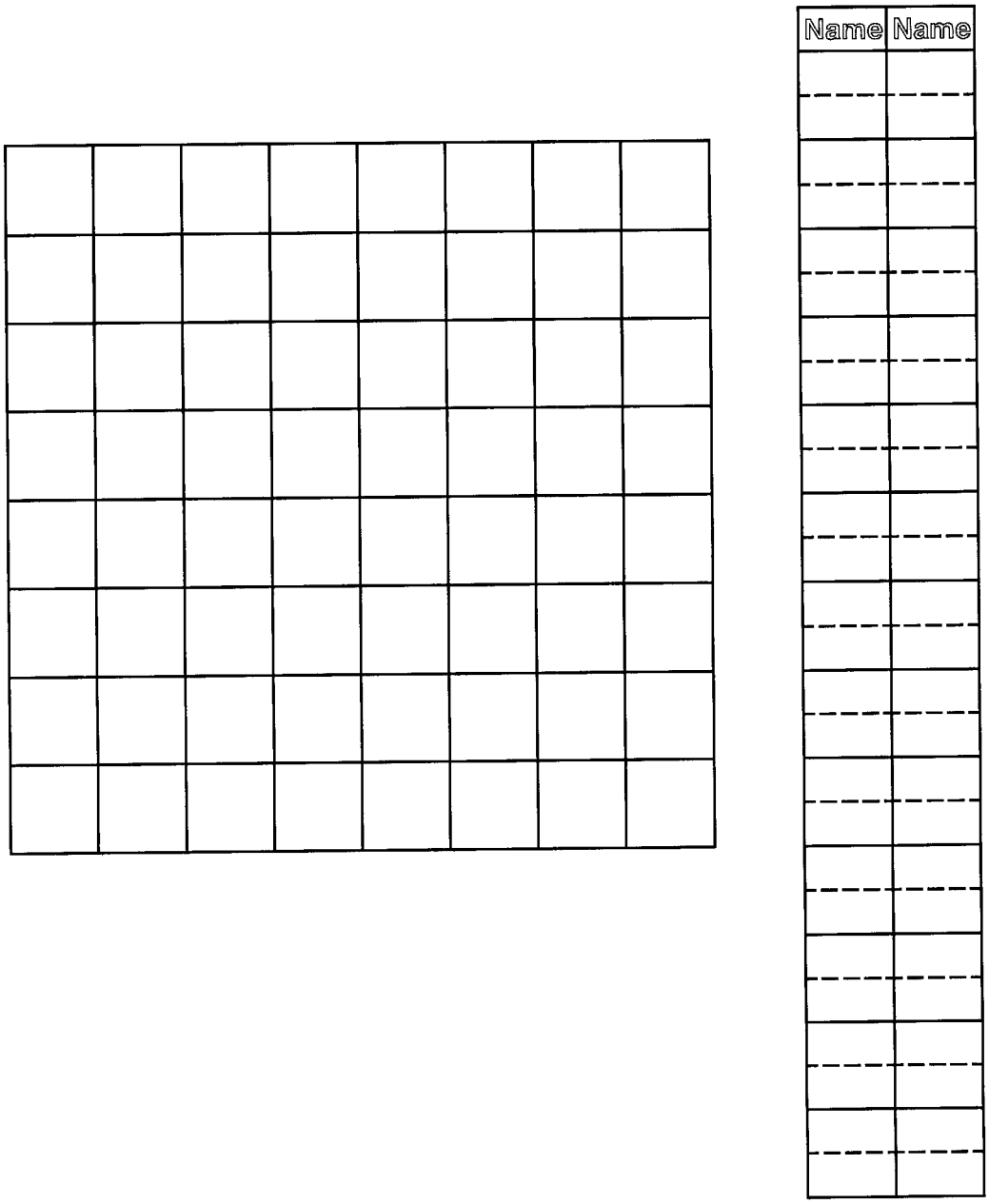
FIG. 9 depicts yet another alternate embodiment of the game incorporated onto a sheet of paper and capable of being played using writing instruments.

FIGS. 7–9 depict versions of the game wherein the game board and score keeping component are contained on a sheet of paper (wherein multiple sheets may be combined in a pad) to facilitate the playing of the game with the playing pieces comprising writing instruments such as red and black ball point pens, pencils, or the like. As should be apparent, the game is played by each player and/or team taking turns marking spaces with a suitable mark (e.g., X's or O's) using the writing instrument in lieu of the placement of playing pieces within the square spaces. FIG. 7 depicts an embodiment wherein a single game may be played using a single sheet of paper. As seen in FIG. 7, the scoring grids each have two columns, with scoring beginning in the left column and then shifting to the right column after the left column is filled, if additional score keeping space is needed. FIG. 8 depicts an embodiment wherein multiple games (e.g., 2) may be played using a single sheet of paper. FIG. 9 depicts yet another alternate embodiment of the game on a sheet of paper. As seen in FIGS. 7–9, score keeping grids are vertically disposed parallel to the depicted playing area(s) on pre-printed sheets. Players and/or teams enter their identity designations in the top boxes of the scoring columns (i.e., names, colors, initials or any other suitable description or identifying notation) before commencing play. After play begins, the players/teams write in their points scored for each square formed, adding the amounts entered in the first two boxes located below their identity designations to obtain a sub-total. As play continues, each successive score is added to the previous sub-total to obtain a new sub-total. The scoring progresses in this manner until squares can no longer be formed or after a player/team reaches a predetermined point total.

The game may also be played at various levels of difficulty to suit the skill of the players. For example, the game may be played at a base level of difficulty (i.e., Level-1 difficulty) by allowing points to be scored only for the formation of basic squares. The game may be played at an intermediate level of difficulty (i.e., Level-2 difficulty) by allowing points to be scored only for the formation of basic squares and Quadras. In addition, the game may be played at a higher level of difficulty (i.e., Level-3 difficulty) by allowing points to be scored for basic squares, Quadras, and open-sided squares. Further enhancements and modifications within the scope of the invention may occur to a person skilled in the art.

The present invention thus provides a challenging and entertaining game for people of all ages. By careful planning and observation players will improve their skill, sharpen their visual perception, and develop advanced strategies.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method of playing a pattern forming game including the steps of:

(a) providing a playing area including a grid pattern defining a plurality of square spaces thereon;

(b) providing a first set of playing pieces and a second set of playing pieces, said first set of playing pieces having a first distinguishing color and said second set of playing pieces having a second distinguishing color;

(c) assigning said first set of playing pieces to a first player and assigning said second set of playing pieces to a second player;

(d) assigning point values to square patterns which can be formed by placement of playing pieces of one color in said square spaces within said playing area, said point values based on the number of spaces from corner-to-corner along one side of a given square pattern;

(e) said first and second players then taking turns placing their respective playing pieces within said square spaces in an effort to form said square patterns while blocking the completion of square patterns by an opponent;

(f) the game ends when either all of the playing pieces have been played and the accumulated points being totaled to determine the winner or when a predetermined point total has been reached.

2. A method of playing a pattern forming game according to claim 1, further including the initial step of determining which of said players is entitled to play the first turn by each of said first and second players rolling a die whereby the player with the highest number is entitled to initiate a game by playing the first turn.

3. A method of playing a pattern forming game according to claim 1, wherein said playing area is on a piece of paper and said playing pieces are writing instruments.

4. A method of playing a pattern forming game according to claim 1, wherein said playing area is on a computer screen and said playing pieces are icons appearing on said computer screen.

5. A method of playing a pattern forming game according to claim 1, wherein said square patterns include: a basic square pattern comprising four playing pieces of one color worth two points; an open-sided square pattern comprising four playing pieces worth points equal to the number of square spaces from corner-to-corner thereof; and a closed-sided square pattern having all sides filled with playing pieces of one color, said closed-sided square pattern worth points equal to twice the number of square spaces from corner-to-corner thereof.

6. A method of playing a pattern forming game according to claim 1, wherein said game board is multi-leveled and square patterns may be formed vertically as well as horizontally.

7. A method of playing a pattern forming game using a game board, having a top surface thereof defining a plurality of square spaces configured in a grid pattern, and a first set of playing pieces of a first color and a second set of playing pieces of a second color, said method including the steps of:

(a) assigning said first and second playing pieces to first and second game players respectively;

(b) assigning point values to square patterns which can be formed by placement of said playing pieces in said square spaces on said game board, said square patterns including basic square patterns formed of four playing pieces of one color positioned in adjacent spaces corresponding to the four corners of a square, open-sided square patterns formed of four playing pieces positioned in spaces corresponding to each of the four corners of a given square pattern, and closed-sided square patterns formed of a plurality of playing pieces positioned in spaces corresponding to each of the four corners and sides of a given square pattern;

(c) said point values depending on the number of square spaces from corner-to-corner along one side of a given square pattern;

(d) said first and second players then taking turns placing their respective playing pieces within said square spaces on said game board in an effort to form said square patterns while blocking the completion of square patterns by an opponent;

(e) the game ends when either all of the playing pieces have been played and the accumulated points being totaled to determine the winner or when a predetermined point total has been reached.

8. A method of playing a pattern forming game according to claim 7, further including a score keeping component providing means for tallying each player's respective score.

9. A method of playing a pattern forming game according to claim 7, wherein said game board is multi-leveled.

10. A pattern forming game including a game board having a top surface thereof defining a plurality of square spaces configured in a grid pattern, a first set of playing pieces of a first color and a second set of playing pieces of a second color, said pattern forming game played according to a method including the steps of:

(a) assigning said first and second playing pieces to first and second game players respectively;

(b) assigning point values to square patterns which can be formed by placement of said playing pieces in said square spaces on said game board, said square patterns including horizontal and diagonal square patterns, said horizontal and diagonal square patterns including: basic square patterns worth two points each formed by four playing pieces of one color disposed in adjacent spaces corresponding to the four corners of a square; open-sided square patterns formed by four playing pieces of one color disposed in spaces corresponding to the four comers of a square; and closed-sided square patterns formed by a plurality of playing pieces of one color disposed in spaces so as to form a fully enclosed square, said point values for said open-sided and closed-sided squares depending on the number of square spaces from corner-to-corner along one side of a given square pattern, said point values further depending upon whether a square pattern is open-sided or closed-sided;

(c) said first and second players then taking turns placing their respective playing pieces within said square spaces on said game board in an effort to form said square patterns while blocking the completion of square patterns by an opponent;

(d) the game ending when all of the playing pieces have been played and the accumulated points being totaled to determine the winner or when a predetermined point total has been reached.

11. A pattern forming game according to claim 10, wherein said game board is multileveled and wherein square patterns further include vertically oriented square patterns capable of being formed by the placement of playing pieces to form vertical square patterns having corners disposed on at least two distinct vertically spaced game board levels.

12. A pattern forming game according to claim 10, further including means for tallying points accumulated by the respective players.

* * * * *

UNITED STATES PATENT AND TRADEMARK OFFICE

CERTIFICATE OF CORRECTION

Figure 3E:
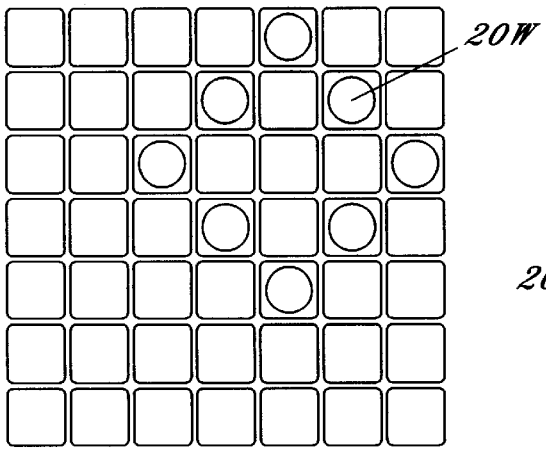
FIG. 3E is a top plan view of the game board having playing pieces disposed thereon forming a diagonal closed-sided square pattern worth six points.
Figure 3F:
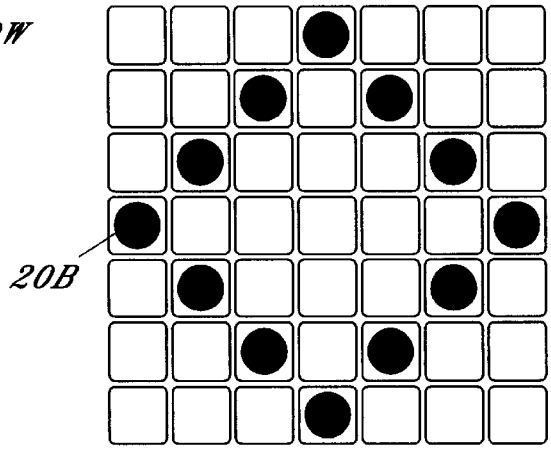
FIG. 3F is a top plan view of the game board having playing pieces disposed thereon forming a diagonal closed-sided square pattern worth eight points.
Figure 4A:
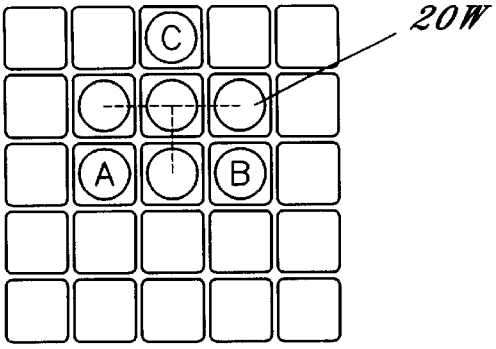
FIG. 4A illustrates various scoring patterns that may be completed with the placement of playing pieces A, B, or C.
Figure 4B:
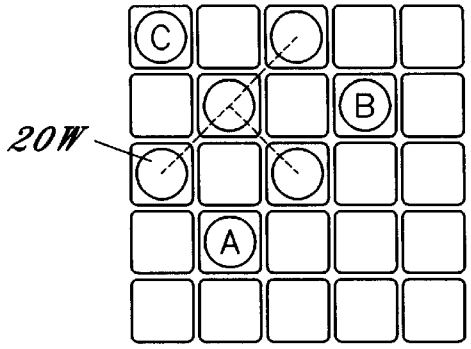
FIG. 4B illustrates various scoring patterns that may be completed with the placement of playing pieces A, B, or C.
Figure 4C:
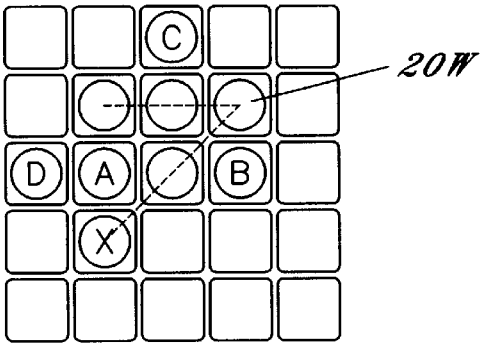
FIG. 4C illustrates various patterns that may be turned into one or more scoring squares with the placement of playing pieces A, B, C or D.
Figure 4D:
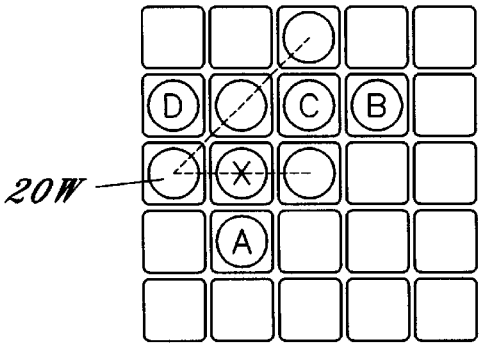
FIG. 4D illustrates various patterns that may be turned into one or more scoring squares with the placement of playing pieces A, B, C or D.
Figure 4E:
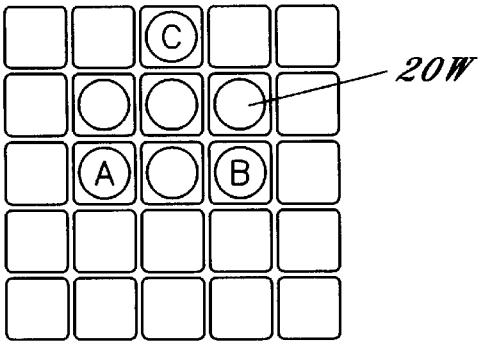
FIG. 4E illustrates various patterns that may be completed by first placing playing piece C thereby creating scoring opportunities indicated by the placement of pieces A or B.
Figure 4F:
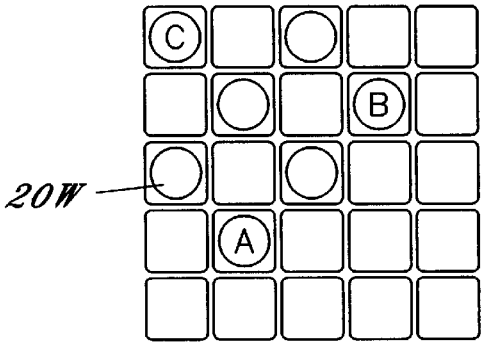
FIG. 4F illustrates various patterns that may be completed by first placing playing piece C thereby creating scoring opportunities indicated by the placement of pieces A or B.
Figure 4G:
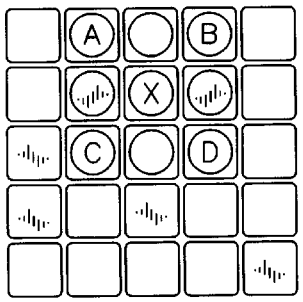
FIG. 4G illustrates how the strategic placement of playing piece X within a previously completed square creates new scoring opportunities by placement of pieces A, B, C, or D.
Figure 4H:
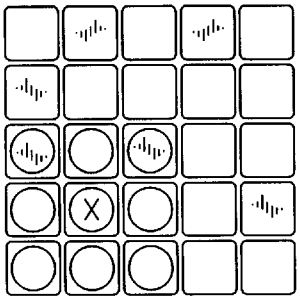
FIG. 4H illustrates how the strategic placement of playing piece X within a previously completed six-point closed-sided square creates four new four-piece squares worth two points each, totaling eight points.

PATENT NO. : 6,276,687 B1
APPLICATION NO. : 09/577648
DATED : August 21, 2001
INVENTOR(S) : Herbert S. Lenhart It is certified that error appears in the above-identified patent and that said Letters Patent is hereby corrected as shown below:

Column 5, Line 50, "FIG. 3'B"' should be corrected to -- FIG. 3E --.

Column 5, Line 62, "horizontal "F"" should be corrected to -- horizontal "T" --.

Signed and Sealed this

Sixth Day of October, 2009

David J. Kappos

David J. Kappos
*Director of the United States Patent and Trademark Office*